US005138290A

United States Patent [19]

Togane et al.

[11] Patent Number: 5,138,290

[45] Date of Patent: Aug. 11, 1992

[54] DEFLECTION YOKE

[75] Inventors: Hikohiro Togane; Chihiro Ikeda, both of Sagamihara, Japan

[73] Assignee: Mitsubishi Denki Kabushiki Kaisha, Tokyo, Japan

[21] Appl. No.: 599,901

[22] Filed: Oct. 19, 1990

[30] Foreign Application Priority Data

Nov. 9, 1989 [JP] Japan ..... 1-291518
Nov. 9, 1989 [JP] Japan ..... 1-291519

[51] Int. Cl.[5] ..... H01F 7/00; H01F 5/00

[52] U.S. Cl. ..... 335/210; 313/440; 335/300

[58] Field of Search ..... 335/210, 211, 212, 213, 335/214, 217, 300; 313/440; 174/137 B, 138 C, 52.2; 336/198, 208, 61

[56] References Cited

U.S. PATENT DOCUMENTS 3,612,742 10/1971 Snowden ..... 174/138 C
4,038,491 7/1977 Gable et al. ..... 174/52.2 X
4,494,097 1/1985 Lenders ..... 335/213
4,624,884 11/1986 Harada et al. ..... 336/96 X
4,673,906 6/1987 Petrow ..... 335/210
4,737,752 4/1988 Kriz ..... 335/210
4,749,975 6/1988 Tokita ..... 335/217

FOREIGN PATENT DOCUMENTS 0238261 9/1987 European Pat. Off. .
0256943 2/1988 European Pat. Off. .
62-252049 11/1987 Japan .
1200542 8/1989 Japan ..... 313/440
58220343 12/1989 Japan .

OTHER PUBLICATIONS

Patent Abstracts of Japan, vol. 12, No. 355 (E-661) (3202) Sep. 22, 1988 & JP-A-63 110 534 (Toshiba Corp.) May 16, 1988.

*Primary Examiner*—Leo P. Picard
*Assistant Examiner*—Ramon Barrena
*Attorney, Agent, or Firm*—Oblon, Spivak, McClelland, Maier & Neustadt

[57] ABSTRACT

A deflection yoke mounted on a television picture tube comprises a horizontal deflection coil, a vertical deflection coil and a separator for isolating the horizontal deflection coil from the vertical deflection coil, wherein the separator is a molded product of a mixture of plastics and granular ceramics having high thermal conductivity.

4 Claims, 7 Drawing Sheets

DEFLECTION YOKE

BACKGROUND OF THE INVENTION

1. Field of the Invention

The present invention relates to a deflection yoke. More particularly, it relates to a deflection yoke to be attached to a television picture tube.

2. Description of the Related Art

Conventional deflection yoke as shown in FIGS. 5 to 7. In FIGS. 5 to 7, reference numeral 1 designates a saddle-toroidal type deflection yoke comprising a horizontal deflection coil 2 having a winding wound in a saddle shape, a high magnetic permeable core 4 disposed at the outside of the horizontal deflection coil 2 through a separator 3 made of a synthetic resinous material and a vertical deflection coil 5 wound in a toroidal shape.

In the conventional deflection yoke having the above-mentioned structure, when a deflecting current having a saw tooth wave is supplied for the scanning of the horizontal and vertical deflection coils 2, 5, a deflection magnetic field is produced. There are simultaneously produced an alternating current transmission loss (a copper loss, an eddy current loss and a surface loss) in the coils 2, 5 and an iron loss (a hysteresis loss and an eddy current loss) in the core 4. These losses become large as the frequency of the deflection current flowing in the coils 2, 5 is high and the intensity of the deflection current is high. Recently, a method of increasing the frequency of a deflecting current to the horizontal deflection coil 2 has been employed to increase the resolution power of a picture image. Further, a wide-angle deflection characteristic has been required to obtain a large display area. This requires a large amount of a deflecting current. Accordingly, the temperature of each element in the deflection yoke 1 is further increased, whereby problems such as a change of convergence due to deterioration in the characteristics of the core 4, the deformation of the separator 3 and the deformation of the deflection yoke, and/or reduction in the durability of the deflection yoke 1 due to the thermal deterioration of the insulating material are.

In the conventional deflection yoke, although attempts have been made to increase the cross-sectional area of the deflection coil and the volume of the core or to provide a cooling fan in order to suppress a temperature rise at each of the elements of the deflection yoke 1 which is caused by supplying a large amount of a deflecting current having a high frequency to the horizontal deflection coil 2 for the purpose of obtaining a high resolution power and a wide-angle deflection characteristic, there still remains a problem that a sufficient cooling effect can not be obtained in a case, in particular, of a type that the scanning is conducted at a high frequency of 130 kHz or having a wideangle deflection of 110°.

SUMMARY OF THE INVENTION

It is an object of the present invention to provide deflection yoke which suppresses a temperature rise in the deflection yoke even when the scanning is conducted at a high frequency or a large deflecting current is supplied.

In accordance with the present invention, there is provided a deflection yoke mounted on a television picture tube which comprises a horizontal deflection coil, a vertical deflection coil and a separator for isolating the horizontal deflection coil from the vertical deflection coil, wherein the separator is a molded product of a mixture of plastics and granular ceramics having high conductivity.

DESCRIPTION OF THE PREFERRED EMBODIMENTS

Preferred embodiments of the deflection yoke of the present invention will be described in detail with reference to the drawings.

Figure 1:
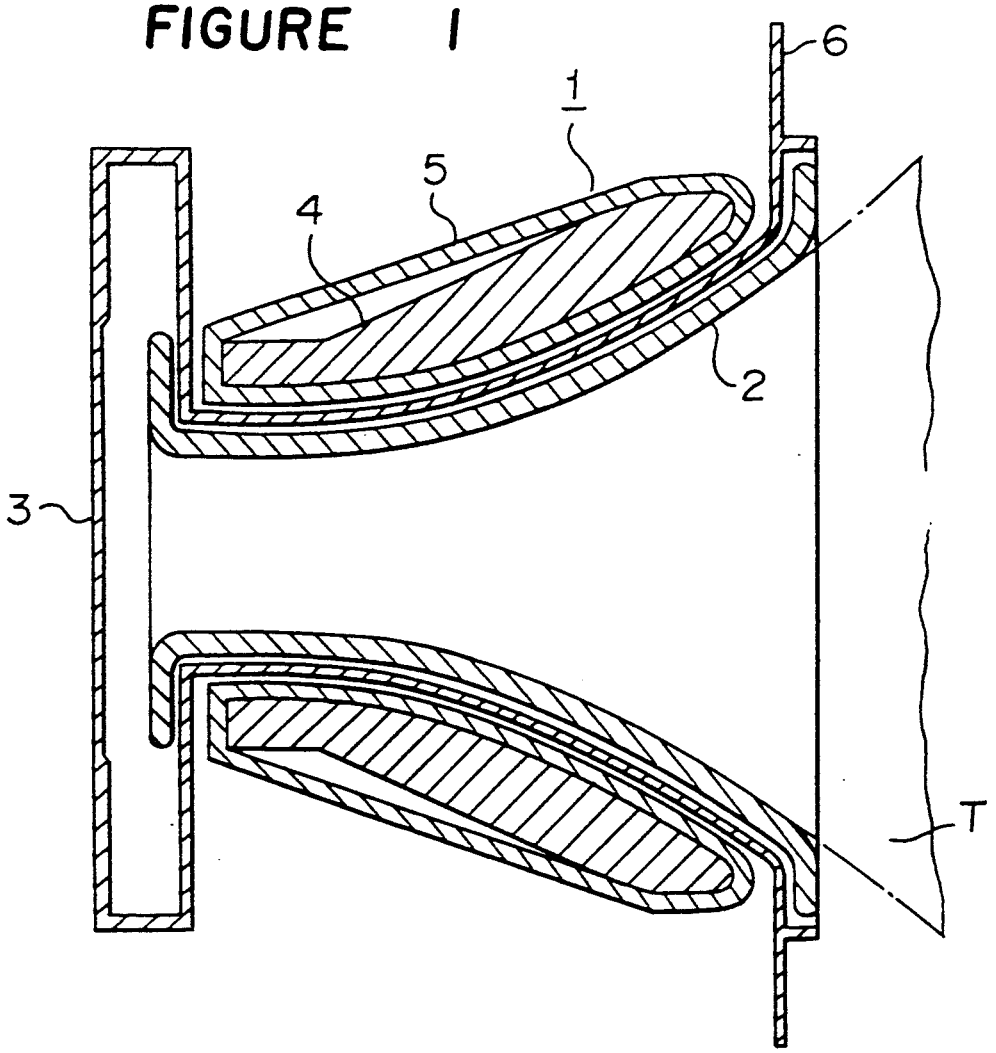
FIG. 1 is a longitudinal cross-sectional view of a first embodiment of the deflection yoke according to the present invention.
Figure 7:
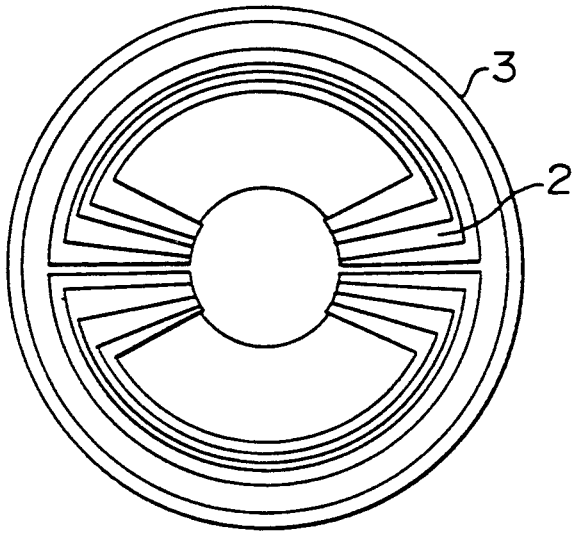
FIG. 7 is a front view of the conventional deflection yoke.
Figure 2:
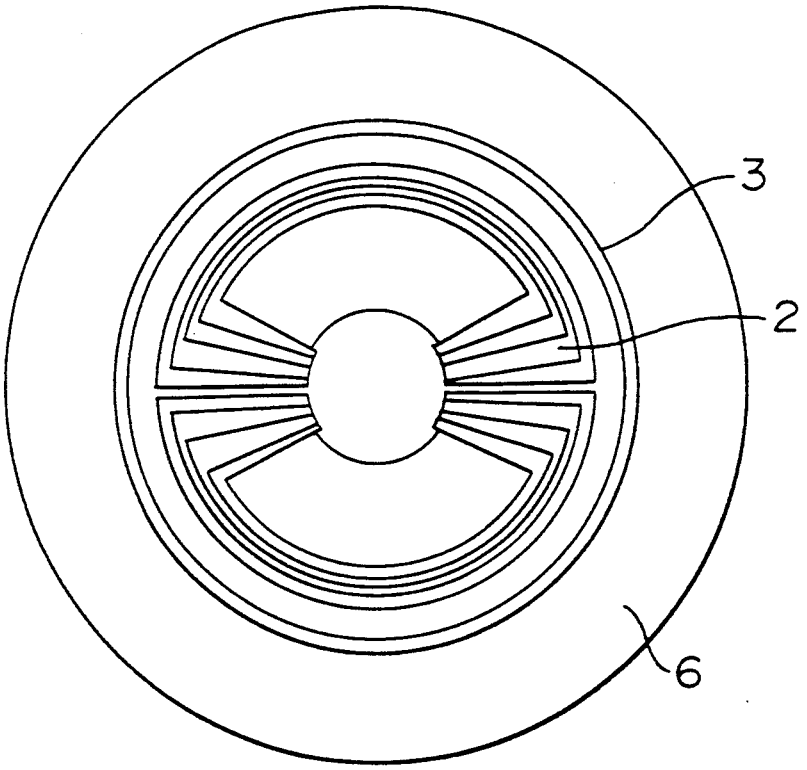
FIG. 2 is a front view of the deflection yoke as shown in FIG. 1.

FIGS. 1 and 2 show in a longitudinal cross-sectional view and a front view a first embodiment of the deflection yoke of the present invention. In FIGS. 1 and 2, a reference numeral 1 designates a saddle-toroidal type deflection yoke, a numeral 2 designates a horizontal deflection coil, a numeral 3 designates a separator having high thermal conductivity, a numeral 4 designates a ferrite core, a numeral 5 designates a vertical deflection coil wound on the core 4, and a numeral 6 designates a heat radiation fin.

Figure 3:
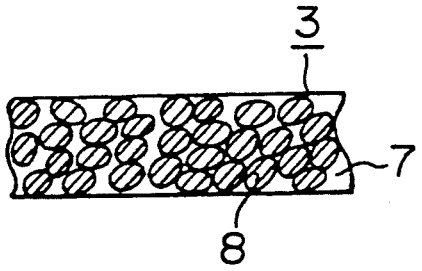
FIG. 3 is an enlarged cross-sectional view partly committed of a separator used for the deflection yoke as in FIG. 1.

The saddle-toroidal type deflection yoke 1 has the horizontal deflection coil 2 disposed on and along the outer circumference of a television picture tube T, the separator 3 disposed at the outside of the horizontal deflection coil 2, the ferrite core 4 disposed at the outside of the separator 3 and the vertical deflection coil 5 wound in a toroidal shape around the ferrite core 4. FIG. 3 is an enlarged cross-sectional view of a part of the separator 3 wherein a reference numeral 7 designates a plastic material and a numeral 8 designates granular ceramics having high thermal conductivity.

The function of the first embodiment of the deflection yoke of the present invention will be described.

Upon actuation of the deflection yoke 1, the temperature of the horizontal deflection coil 2 and the vertical deflection coil 5 is increased due to a copper loss and other losses produced in the coils 2, 5. Further, the temperature of the ferrite core 4 is also increased due to an iron loss in the core 4. On the other hand, the heat radiation fin 6 in contact with ambient air is kept at a relatively low temperature since the separator 3 itself does not generate heat. Accordingly, since there is a temperature difference between the temperature of a portion of the separator 3 interposed between the horizontal deflection coil 2 and the core 4 and the temperature of the fin 6 in contact with ambient air, heat produced in the horizontal and vertical deflection coils 2, 5 and the core 4 is transferred and discharged efficiently in air through the separator 3 having high thermal conductivity. Therefore, the temperature of the horizontal and vertical deflection coils 2, 5 and the core 4 is reduced. As a result, the resolution power for a picture image can be improved by increasing the frequency of a deflecting current, and a display having a wide-angle deflection can be obtained by increasing the deflecting current.

In the first embodiment of the present invention, since the separator 3 for isolating the horizontal deflection coil 2 in the deflection yoke attached to the television picture tube T from the vertical deflection coil 5 is a molded body of a mixture of plastics and granular ceramics having high thermal conductivity, the separator 3 possesses high thermal conductivity whereby the deflection yoke 1 suppresses a temperature rise even when the deflection yoke is actuated by a large amount of a deflecting current and/or the deflection current has a high frequency.

As a material for forming the separator 3, polypropylene, phenylenoxide or PBT is preferably used. The ceramics may be alumina, aluminum nitride or the like, and the granular ceramics are mixed with the plastics at 70%-80% by weight.

Further, as shown in FIG. 1, since the separator 3 for isolating the horizontal deflection coil 2 from the vertical deflection coil 5 is enlarged at the side of the screen portion and the side of the neck portion of the television picture tube T, heat produced in the horizontal and vertical deflection coils 2, 5 and the core 4 can be further efficiently diffused in air through the separator 3.

In the above-mentioned embodiment, description has been made as to the saddle-toroidal type deflection yoke. However, the present invention is not restricted to such type of deflection yoke, and the same effect can be obtained even by using a toroidal-toroidal type deflection yoke or a saddle-saddle type deflection yoke.

Figure 8:
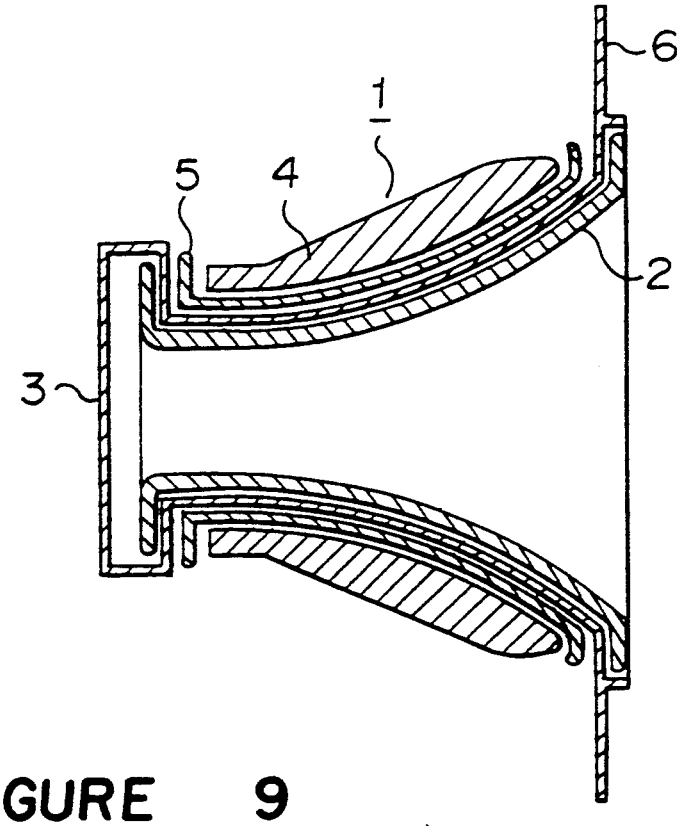
FIG. 8 is a longitudinal cross-sectional view of another embodiment of the deflection yoke of the present invention.
Figure 9:
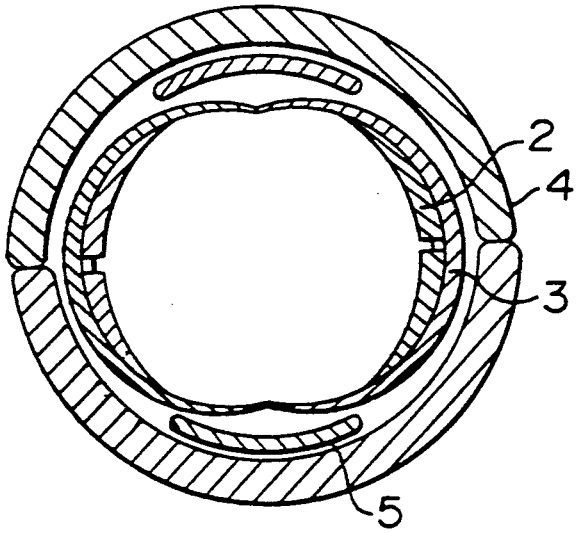
FIG. 9 is a transverse cross-sectional view of the diflection yoke as shown in FIG. 8.

FIGS. 8 and 9 show an embodiment of the saddle-saddle type deflection yoke of the present invention, wherein the same reference numerals as in FIGS. 1 through 3 designate the same or corresponding parts.

In FIGS. 8 and 9, the vertical deflection coil is not wound on the core 4 as seen in FIGS. 1 through 3, but is placed between the core 4 and the separator 3. The heat radiation fin 6 is outwardly extended. In the same manner as the embodiment of FIGS. 1 through 3, a copper loss produced in the vertical and horizontal deflection coils is effectively discharged in air through the separator 3 and the heat radiation fin 6, whereby temperature rise in the deflection yoke can be suppressed to a low level.

In the above-mentioned embodiments, the separator 3 and the heat radiation fin 6 are formed integrally. However, the same effect can be obtained by forming the heat radiation fin 6 made of a material having high thermal conductivity and high electric resistance separately, the radiation fin 6 being attached to the separator 3.

Figure 10:
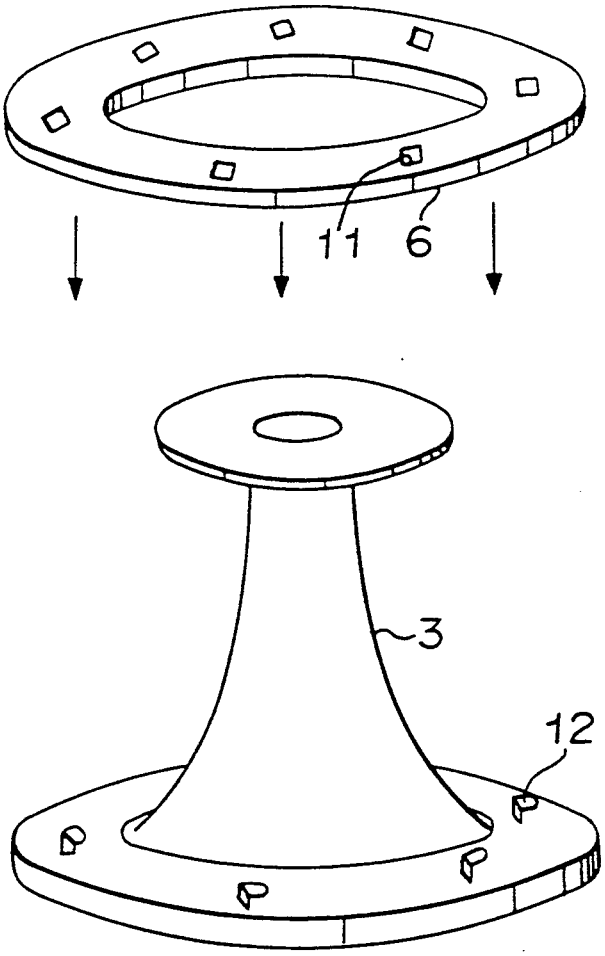
FIGS. 10 and 11 are perspective views showing another embodiment of the deflection yoke of the present invention in which states of assembling a separator and a heat radiation fin are shown.
Figure 11:
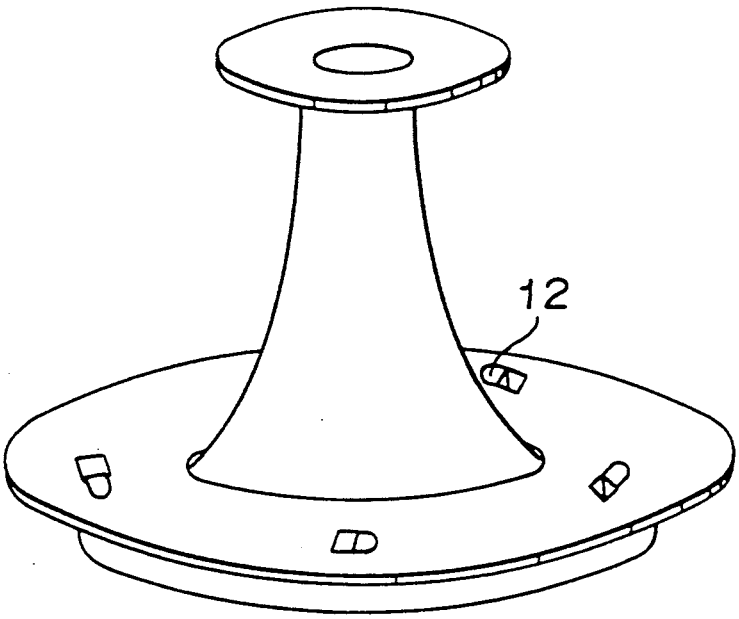
Figure 12:
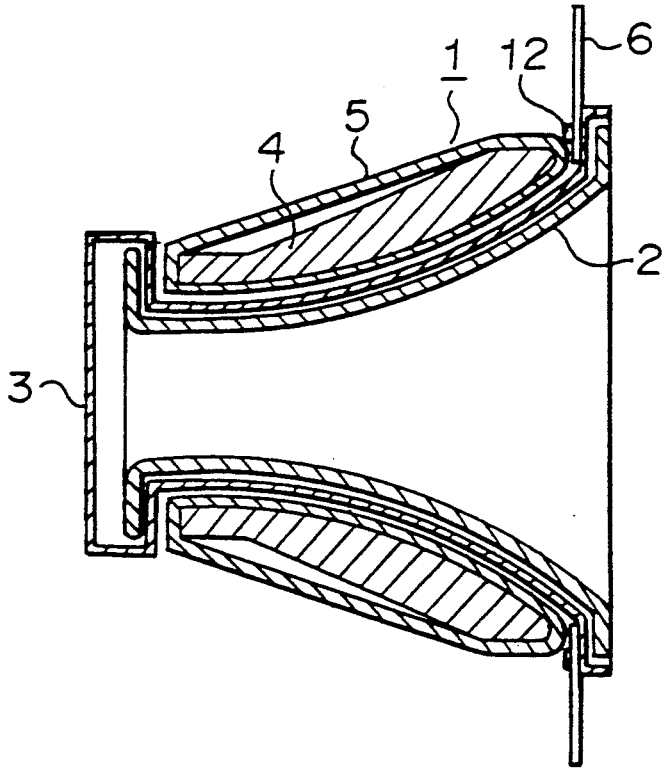
FIG. 12 is a longitudinal cross-sectional view of the deflection yoke in the complete form.

FIGS. 10 through 12 show an embodiment of the deflection yoke of a type wherein the separator 3 and the heat radiation fin 6 are separately prepared. In FIG. 10, the separator 3 has a flange portion, and a plurality of pawls 12 are formed or attached to the inner surface of the flange. The heat radiation fin 6 having a flat annular ring shape is provided with openings 11 in number corresponding to that of the pawls 12. The heat radiation fin 6 is fitted to the flange of the separator 3 by inserting the pawls 12 into the openings and by turning either the separator 3 or the radiation fin 6 in a plan perpendicular to the axis of the Television picture tube T. FIG. 12 shows the deflection yoke 1 assembled in a manner as described above.

Figure 4:
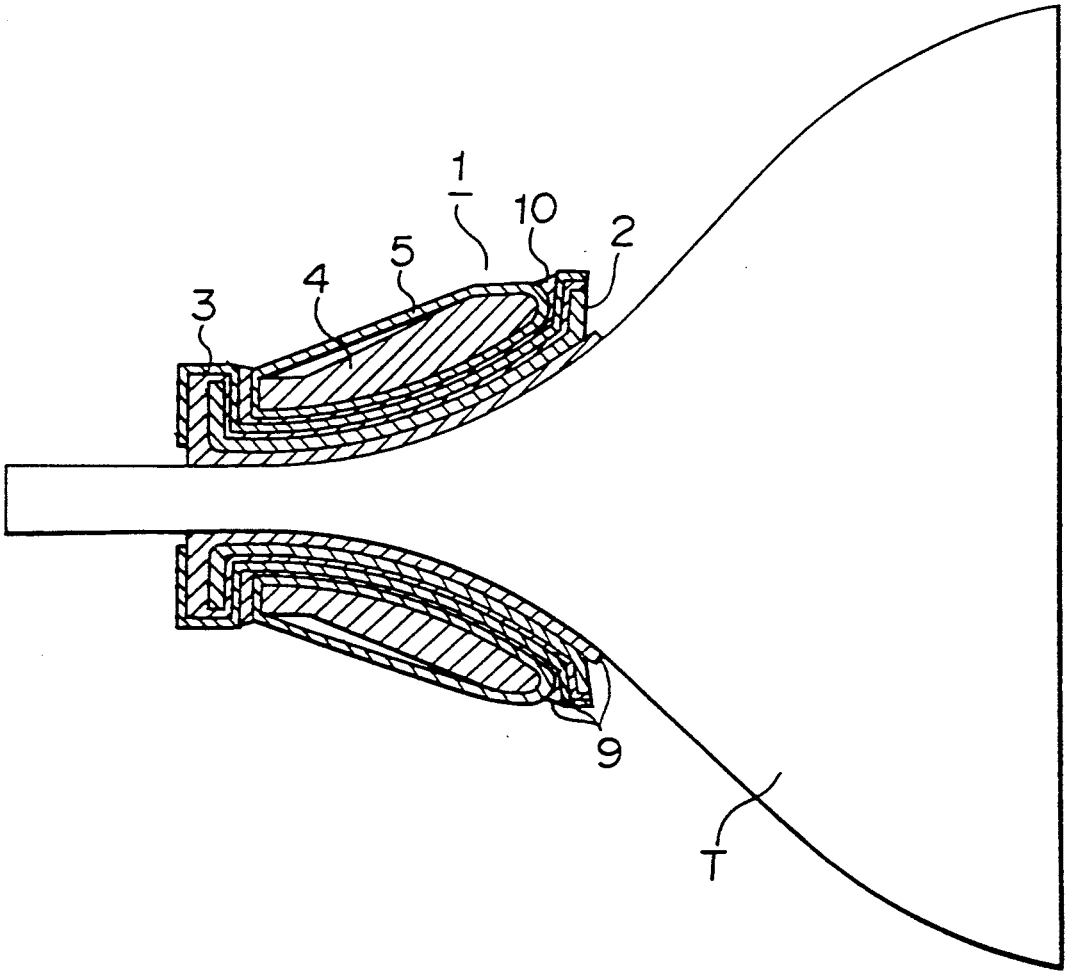
FIG. 4 is a longitudinal cross-sectional view of a second embodiment of the deflection yoke according to the present invention.
Figure 5:
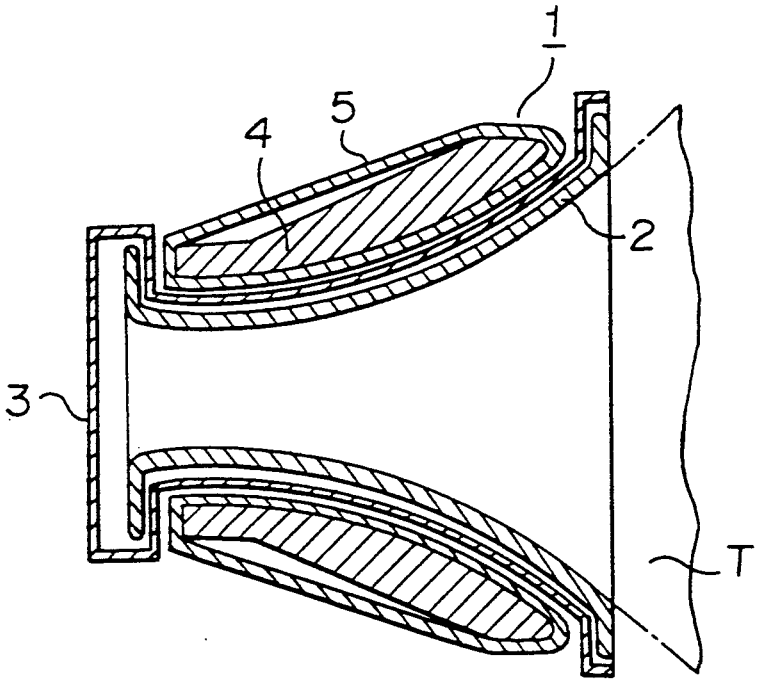
FIG. 5 is a longitudinal cross-sectional view of a conventional deflection yoke.
Figure 6:
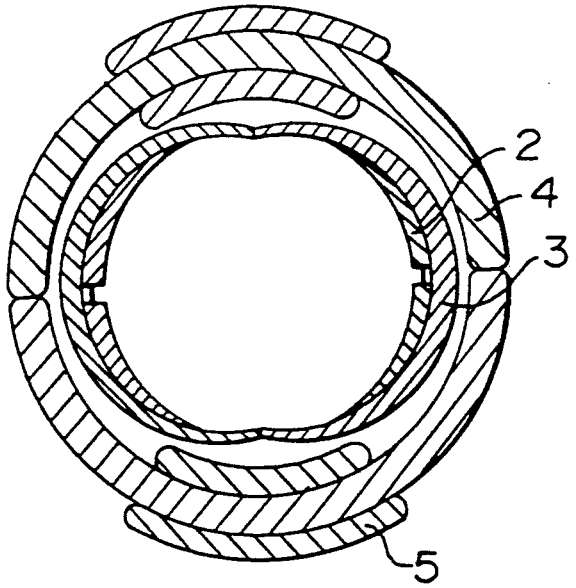
FIG. 6 is a transversal cross-sectional view of the conventional yoke.

Another embodiment of the deflection yoke 1 of the present invention will be described with reference to FIG. 4. Usually, deflection yoke 1 has a space between the television picture tube, i.e. the cathode ray tube T and the horizontal deflection coil 2, a space between the horizontal deflection coil 2 and the separator 3 and a space 10 between the separator 3 and the vertical deflection coil 5. In this embodiment, a resinous material 9 having high thermal conductivity is entirely or partially filled in these spaces so that they are bonded and fixed to each other. In FIG. 4, the same reference numerals as in FIGS. 1-3 designate the same or corresponding parts.

The function of the second embodiment of the present invention will be described.

The deflection yoke 1 is mounted on the cathode ray tube T. A high thermal conductive resin 9 is injected into the spaces in the deflection yoke 1 and between the deflection yoke 1 and the cathode ray tube T from a desired portion or desired portions of the deflection yoke 1 so that the cathode ray tube T and the deflection yoke 1 are bonded and fixed to each other. Thus, heat produced in the deflection yoke 1 can be easily transmitted toward the cathode ray tube.

It is important that heat from the horizontal deflection coil 2 is effectively transmitted to the cathode ray tube T because a temperature rise at the time of actuation of the deflection yoke 1 is mainly caused by a copper loss produced in the horizontal deflection coil 2. In this embodiment, silicone resin is used as the resinous material having high thermal conductivity. According to this embodiment, temperature could be reduced by 5° C. in comparison with a case that the resinous material was not used.

In the second embodiment of the present invention, a heat transmission passage is formed by injecting the high thermal conductive resin 9 in the inner spaces of the deflection yoke 1 and the space 9 between the deflection yoke 1 and the television picture tube T so that a temperature rise in the deflection yoke 1 is suppressed. Accordingly, a highly reliable deflection yoke can be provided wherein the temperature rise of the deflection yoke is reduced and excellent function can be expected even when the horizontal and vertical coils are scanned with a current of a high frequency and a large amount of current is used.

In the above-mentioned embodiment, alumina hydroxide as filler may be mixed with silicone resin. In this case, a temperature reducing effect of 8° C. was obtained. Or the silicone resin, polybutadiene resin or another suitable resin may be used so long as it has high thermal conductivity.

For alumina hydroxide, another suitable material may be used as filler so long as it is useful for improving thermal conductivity.

In the second embodiment, description has been made as to use the deflection yoke 1 of a saddle-toroidal type. However, the same effect can be achieved even by using a saddle-saddle type deflection yoke or a toroidal-toroidal type deflection yoke.

Thus, in accordance with the present invention, temperature rise can be suppressed even by actuating a large amount of current having a high frequency because the function of a heat radiation fin is given to the separator. Further, since a thermal conducting passage is formed by injecting a high thermal conductive resin in spaces in the deflection yoke and a space between the deflection yoke and a television picture tube, an appropriate operation of the deflection yoke can be expected and a highly reliable deflection yoke can be obtained.

We claim:

1. A deflection yoke mounted on a television picture tube comprising:

a horizontal deflection coil, a vertical deflection coil, and a separator extending completely between said horizontal deflection coil and said vertical deflection coil for isolating said horizontal deflection coil from said vertical deflection coil, said separator comprising a radially outwardly extending heat radiation fin at a screen portion side of said picture tube for contact with air, said separate being entirely comprised of a mixture of plastics and granular ceramics having a high thermal conductivity.

2. The deflection yoke according to claim 1, wherein said heat radiation fin is removably attached to the separator.

3. The deflection yoke according to claim 1, wherein the separator is provided integrally with said heat radiation fin.

4. The deflection yoke according to claim 2, wherein one of said heat radiation fin and said separator comprises openings for cooperating with corresponding pawls on the other of said heat radiation fin and separator to enable the attachment of said heat radiation fin to said separator.

* * * * *